US006302114B1

(12) United States Patent
Clarke et al.

(10) Patent No.: US 6,302,114 B1
(45) Date of Patent: Oct. 16, 2001

(54) TOBACCO SMOKE FILTER

(75) Inventors: Paul Francis Clarke; John Charlton, both of Tyne & Wear (GB)

(73) Assignee: Cigarette Components Limited, Stoke Poges (GB)

( * ) Notice: Subject to any disclaimer, the term of this patent is extended or adjusted under 35 U.S.C. 154(b) by 0 days.

(21) Appl. No.: 07/960,737

(22) Filed: Oct. 14, 1992

(30) Foreign Application Priority Data

Oct. 14, 1991 (GB) ..... 9121782

(51) Int. Cl.[7] ..... A24D 1/02; A24B 1/04; D21F 11/00

(52) U.S. Cl. ..... 131/365; 131/361; 131/362; 131/342; 131/331; 131/200; 131/202; 131/203; 162/139

(58) Field of Search ..... 131/200, 201, 131/202, 331, 334, 360, 365, 361, 362, 203, 342; 162/139

(56) References Cited

U.S. PATENT DOCUMENTS

| | | | | |
|---|---|---|---|---|
| 2,819,720 | * | 1/1958 | Burbig | 131/336 |
| 2,905,184 | * | 9/1959 | Schur | 131/343 |
| 3,318,317 | * | 5/1967 | Spioull | 131/342 |
| 3,596,663 | * | 8/1971 | Schultz | 131/336 |
| 3,733,246 | * | 5/1973 | Thomson et al. | 131/343 X |
| 3,744,497 | * | 7/1973 | Marciuliano | 131/342 |
| 5,009,239 | * | 4/1991 | Cohen et al. | 131/342 |
| 5,038,803 | * | 8/1991 | Cohen et al. | 131/342 |

FOREIGN PATENT DOCUMENTS

| | | | |
|---|---|---|---|
| 437599 | | 10/1935 | (GB) . |
| 476746 | | 12/1937 | (GB) . |
| 739259 | | 10/1955 | (GB) . |
| 741429 | | 12/1955 | (GB) . |
| 823690 | | 11/1959 | (GB) . |
| 1023918 | | 3/1966 | (GB) . |
| 1045826 | | 10/1966 | (GB) . |
| 1096113 | | 12/1967 | (GB) . |
| 1121474 | * | 7/1968 | (GB) . |
| 1449031 | * | 9/1976 | (GB) . |
| 2223393 | * | 4/1990 | (GB) . |
| 2236239 | * | 4/1991 | (GB) . |
| 2249936 | | 5/1992 | (GB) . |

* cited by examiner

*Primary Examiner*—Stanley S. Silverman
*Assistant Examiner*—Dionne A. Walls
(74) *Attorney, Agent, or Firm*—Scully, Scott, Murphy & Presser

(57) ABSTRACT

The present invention provides a tobacco smoke filter or filter element having a longitudinally extending core (2) and a wrapper (4) engaged around the core (2), the wrapper (4) having particulate additive (6) adhered to one or more portion(s) of the radially inner face thereof with said wrapper (4) being free of additive around its circumference at one or both ends of the core.

8 Claims, 2 Drawing Sheets

TOBACCO SMOKE FILTER

The present invention concerns tobacco smoke filters and filter elements containing particulate smoke-modifying additive.

Suitable particulate additives include sorbents (e.g. selected from activated carbon, silica gel, sepiolite, alumina, ion exchange material etc.), pH modifiers (e.g. alkaline materials such as $Na_2CO_3$, acidic materials), flavourants, other solid additives and mixtures thereof.

The present invention provides a tobacco smoke filter or filter element having a longitudinally extending core and a wrapper engaged around the core, the wrapper having particulate additive adhered to one or more portion(s) of the radially inner face thereof with said wrapper being free of additive around its circumference at one or both ends of the core.

The particulate additive preferably extends only partially around the inner circumference of the wrapper—the wrapper for example having an overlapping longitudinal edge which is free of said additive and provides a lapped and stuck seam holding the wrapper around the core. The particulate additive may cover a single region of the inner surface of the wrapper extending from one end of the core partially towards the other; it may cover a single region which is spaced from both ends of the core; it may be disposed in separate regions spaced longitudinally and/or circumferentially from one another. Any particulate additive used may be a single substance or a mixture, and may be in admixture with other material.

The wrapper is preferably pre-coated with the adhering particulate smoke modifying additive. The core may be pre-formed before application of the coated wrapper, or formation of the core and application of the coated wrapper may occur substantially simultaneously.

The particulate additive is suitably adhered to the wrapper by hot melt adhesive, high m.p. polyethyelene glycol, or emulsion-type adhesive such as PVA. Suitable hot-melt adhesives for use in the invention are various polyester adhesives.

In the filter or element according to the invention the core can be of conventional smoke filtering material (e.g. of filamtentary tow, staple fibre, or creped paper); an open ended tube; or an impermable or low-permeability portion which contributes to the composite filter pressure drop but has little or no filtering effect; the core could be a unitary body, or it could be a composite—e.g. incorporating its own sleeve and/or having longitudinally (and/or radially) adjacent portions. In one type of embodiment the core wrapper is itself surrounded by an outer annular body—which, like the core, could for example be of conventional smoke filtering material or an impermeable or low-permeability portion with little or no filtering effect. The core can be a composite of a central rod and a sleeve. The core, with or without such sleeve, may have external grooves extending longitudinally thereof over part of its length, in which case the particulate additive on the radially inner face of the wrapper may be in register with and extend into these grooves. The grooves may extend from one or each end of the core partially towards the other, or stop short of both ends. In a composite core of a rod with a grooved sleeve, the rod surface may conform to the sleeve grooves.

Filters and elements according to the invention may have an outer containing sleeve e.g. an extruded sleeve or a plugwrap with a lapped and stuck seam; such a plugwrap could be of air-permeable or -impermeable material, and in either case may be perforated. The particulate-coated wrapper could be adhered (e.g. with heat-activatable adhesive) to the core to give a bonded product which is dimensionally stable without a containing sleeve. In another arrangement, one or both longitudinal wrapper edges may be without particulate coating and be used as an adhesive overlap to hold the wrapper around the core. However, even with bonding of the wrapper to itself and/or to the core, it may be preferred to provide a containing sleeve around the wrapper.

The preformed particulate additive-coated wrapper is conveniently applied around a preformed core, or around a core as the core is being formed, using conventional garniture apparatus. In a method according to the invention the supply of the particulate additive-carrying wrapper, the application thereof to the core after or whilst the latter is formed (optionally with application of a surrounding sleeve), and cutting of the resulting elongate product into finite lengths, can be conducted continuously and in-line using conventional filter manufacturing machinery. Where the wrapper is itself to be surrounded by an outer annular body, the latter may be similarly continuously fed and formed around the advancing wrapped core; continuous in-line procedures and apparatus for these operations are known in the cigarette filter art. The finite lengths cut initially from the continuously produced product will usually be multiples of the eventually used individual filters or elements; in this case the initial finite lengths are further subdivided into final unit lengths during or for subsequent formation of filter cigarettes, and are also according to the invention. The wrapper may be coated with adhesive over the restricted regions where particulate additive coating is required (e.g. by a printing wheel), and then with particulate additive (e.g. by drawing through a reservoir, fluidised bed, circulated stream or other supply of the additive whilst the adhesive is active) as part of the above in-line continuous process; instead adhesive-coated strip may be separately produced or obtained from an outside supplier, with activation (e.g. heat-softening) of the adhesive and application of particulate additive being conducted in-line and continuously with filter production. Filters according to the invention may incorporate other material.

Various parameters may vary widely according to product requirements, these including for example weight/unit length of the wrapper used to carry the particulate additive, the particle size of the additive, etc. A suitable particle size for activated carbon is 12/30 British Standard Mesh, and another is 30/70 British Standard Mesh.

The wrapper employed according to the invention may be of any innoxious material. It will usually be a conventional plugwrap, and may be permeable or impermeable to smoke or air, according to the flow requirements in the final product. When intended for a ventilated filter, the wrapper will usually be highly porous. The wrapper may have external grooves extending longitudinally over part of its length, in which case the particulate additive on its radially inner face is preferably at an ungrooved region; the grooves may extend from one or each end of the wrapper partially towards the other, or stop short of both ends; the core surface may conform to the wrapper grooves.

At least some of the particulate additive used may carry (or consist of) flavourant—or other material carrying flavourant may be incorporated.

The invention can provide, without the need for production and subsequent longitudinal alignment and combination of separate elements, a unitary filter element which carries advantageous particulate additive and which yet can present an acceptable, plain, additive-free appearance at the buccal end of a filter cigarette. It also permits incorporation of activated carbon or other particulate additive in tobacco smoke filters using conventional apparatus without introducing production or apparatus problems and in particular with ready achievement of uniform additive loading—and simple and accurate variation of this loading when required. Filters according to the invention allow the particulate additive adhered to the radially inner face of the wrapper to exercise, unhindered or substantially so, its filtering or other effect on the tobacco smoke stream; thus filters according to the invention containing particulate sorbent can give good retention of vapour phase smoke components.

Products according to the invention are generally suitable for use as or in cigarette filters. Cigarette filters according to the invention will usually be attached to wrapped tobacco rods by conventional tipping overwrap, which may be ventilating or non-ventilating overwrap; usually, as indicated above, the filter will be orientated with an additive-free portion at the buccal end.

Embodiments of the invention are illustrated in the accompanying drawings. In the drawings like reference numerals indicate like parts and:

FIG. 1 is a diagrammatic longituginal sectional view of one filter according to the invention having a filtering core 2 surrounded by a porous plugwrap 4 which has particulate additive 6 adhered to its inner surface so as to extend around and engage the full circumference of core 2, this additive extending from one end of the filter only partially towards the other; the plugwrap 4 is secured around the core 2 by a lapped and stuck seam (not shown) which is free of particulate additive.

FIG. 2 is a similar view of an embodiment which is the same as that of FIG. 1 except that the particulate additive 6 is absent from the wrapper 4 around both ends of the core 2.

FIG. 3 is a longitudinal view, part sectional and part broken away, of a filter according to the invention having a filtering core 2 wrapped in a porous wrap 4 through which longitudinally and circumferentially spaced patches 8 of particulate additive 6 are visible.

FIG. 4 is the same view of an essentially similar embodiment in which the patches 8 are of oval shape.

FIG. 5 is a longitudinal view, part sectional and part broken away, of part of a multiple length rod according to the invention which can be cut into individual units like that shown in FIG. 2—by transverse cutting between the longitudinally spaced patches of particulate additive; the particulate additive-free lapped and stuck seam is indicated schematically at 10. In this case additive 6 is not shown as visible through wrapper 4.

FIG. 6 is a view, similar to that of FIG. 1, in which the FIG. 1 wrapper is itself surrounded by an annular body 12 of filter material, which would usually be encompassed in an outermost wrapper 14; in this illustrated embodiment, the additive-coated wrapper 4 is impermeable, and as with the other embodiments illustrated the filter would be attached to a cigarette rod with the additive-free end exposed to the mouth of the smoker. Core 2 in FIG. 6 is slimmer than that in FIG. 1, so that the overall circumferences of the FIG. 1 and FIG. 6 products are about the same—usually about 25 mm.

In FIGS. 1 to 6 a narrow gap is shown between core 2 and the additive-free part of wrapper 4; this is due to the diagrammatic nature of the FIGS; in practice there will be no such gap, the uncoated inner face portion of wrapper 4 contacting and engaging around the periphery of core 2.

FIG. 7 is a diagrammatic perspective view, part broken away, of a filter according to the invention in which the wrapper 4 around the filtering core 2 has grooves 16 extending from one end face 17 partially towards the other end face 19. The particulate additive 6 is adhered to the inner face of the plain ungrooved portion 18 of wrapper 4. Core 2 is suitably of cellulose acetate tow and wrapper 4 of air-permeable paper plugwrap. The illustrated filter is shown provided with its own outermost plugwrap 21; this is applied as a final step in the continuous in-line rod production process before the continuously formed product is cut to finite lengths; outer plugwrap 21, which can be permeable or impermeable, is thus co-terminous with the rod. In other embodiments the plugwrap 21 can be omitted, leaving an initial filter product with grooves 16 exposed.

The filter could have its grooved or ungrooved end attached to a cigarette, usually by a tipping overwrap which could be non-ventilating or provide ventilation—e.g. into grooves 16. For use with a ventilating tipping overwrap, the filter would usually be supplied with no outer plugwrap 21, so that the tipping overwrap would engage directly around wrapper 4.

In the illustrated embodiment, the core surface beneath grooves 16 conforms to the grooved configuration, but this is not essential—i.e. the grooved portion of wrapper 4 could define internal grooves between itself and core 2 as well as the external grooves 16. In the illustrated embodiment the particulate additive 6 extends circumferentially continuously around the core 2, the inner face of wrapper 4 in this region being free of additive only where it overlaps the outer face to form a lapped and stuck seam (not shown); however, as with previous embodiments, this is not essential, it being possible for additive 6 to be present over only part of the core circumference—e.g. over separate circumferentially spaced regions. In the illustrated embodiment the particulate additive 6 extends over the full length of the ungrooved portion 18 of wrapper 4, but again this is not essential; the particulate additive, disposed circumferentially in any of the ways mentioned above, could extend only part of the length of the ungrooved wrapper portion 18, e.g. being absent from the wrapper 4 at end face 19 and/or disposed in separate longitudinally spaced regions.

Figure 1:
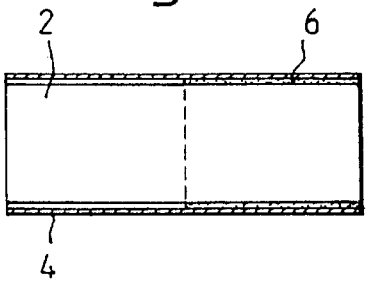
Figure 2:
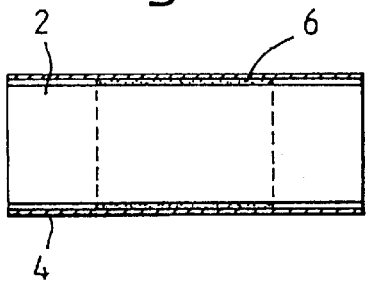
Figure 3:
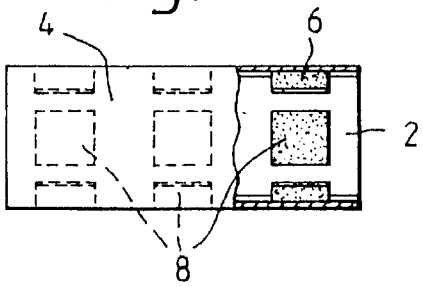
Figure 4:
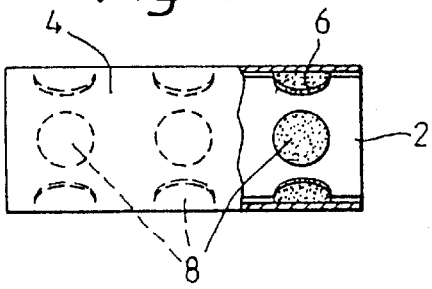
Figure 5:
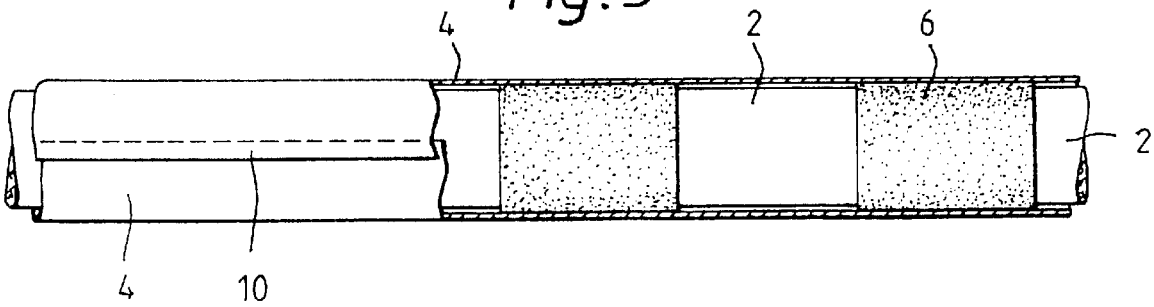
Figure 6:
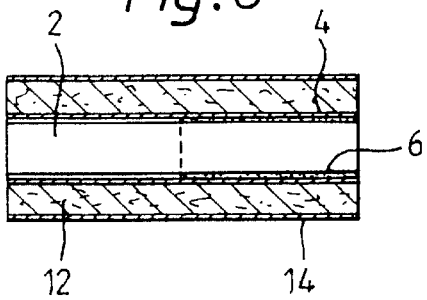
Figure 7:
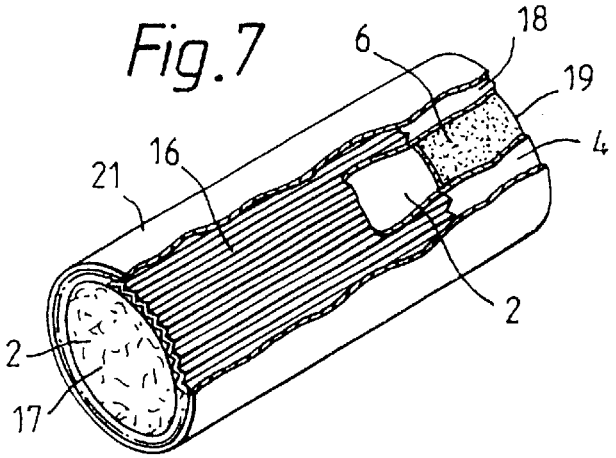
Figure 8:
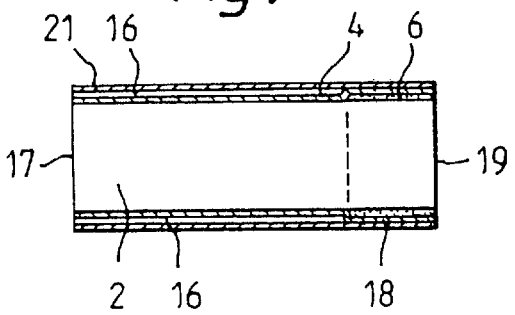
FIG. 8 is a diagrammatic longitudinal sectional view of the filter of FIG. 7.
Figure 9:
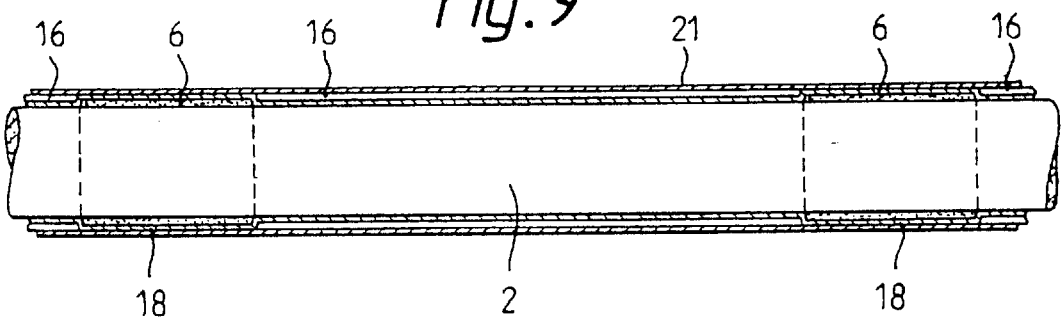
FIG. 9 is a diagrammatic longitudinal sectional view of part of a multiple length rod according to the invention which can be cut into individual units like that of FIGS. 7 and 8.
Figure 10:
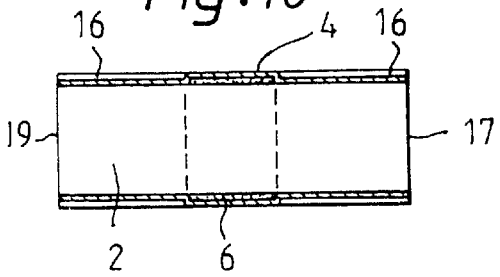

FIG. 10 is a diagrammatic longitudinal sectional view of a modification of the FIG. 8 filter, in which the ungrooved portion 18 of wrapper 4 having the particulate additive 6 adhered to its inner surface is located inboard of two regions having grooves 16 extending to the respective end faces 17 and 19. This embodiment is shown without the outer plugwrap of FIGS. 7–9, but such an outer plugwrap 21 could be provided. The variations discussed above with reference to FIGS. 7 to 9, concerning disposition of particulate additive over the ungrooved region, conformation of the surface of core 2 with grooves 16, and attachment of the filter to a cigarette rod, apply also to the embodiment of FIG. 10. The FIG. 10 rod could be obtained from an appropriate corresponding multiple length rod in the manner indicated in connection with FIGS. 7 to 9.

Figure 11:
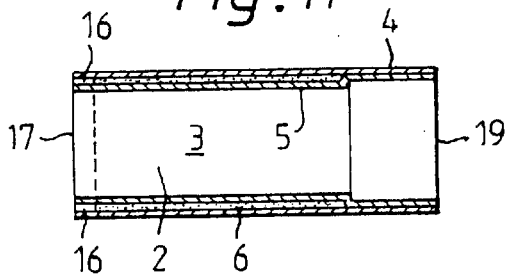

FIG. 11 is a diagrammatic longitudinal sectional view of a filter according to the invention of the type in which the core 2 is a composite of a central rod 3 and a sleeve 5, sleeve 5 in this case being grooved over part of its length extending from one end face 17 with the external surface of rod 3 conforming to grooves 16 over this region. In this case, wrapper 4 is of plain, ungrooved configuration, and has particulate additive 6 adhered to its inner face extending into and filling grooves 16 over part of their length stopping short of end face 17. Variations of the illustrated arrangement are possible, as indicated above in connection with the FIG. 7 embodiment. Thus the particulate additive 6 may extend circumferentially continuously around the core 2, the inner face of wrapper 4 in this region being free of additive only where it overlaps the outer face to form a lapped and stuck seam (not shown), or the additive may be present over only part of the core circumference—e.g. over separate circumferentially spaced regions. The particulate additive 6, illustrated as extending continuously over part of the length of the grooved core portion, could instead extend continuously over the full groove length or over separate longitudinally spaced regions of the groove length. Central rod 3 is suitably of cellulose acetate tow and sleeve 5 of cellulose acetate or porous plugwrap. Wrapper 4 can be of air-permeable paper plugwrap. The filter could have its grooved or ungrooved end attached to a cigarette, ususally by a tipping overwrap which could be non-ventilating or provide ventilation. In the illustrated embodiment, the surface of rod 3 conforms to grooves 16 in sleeve 5, but the grooved portion of sleeve 5 could instead define internal grooves between itself and rod 3.

Figure 12:
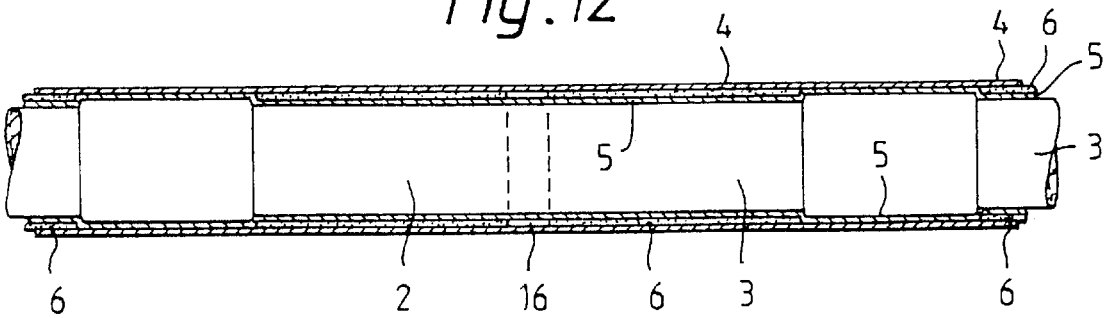

The FIG. 12 shows, in a view similar to that of FIG. 9, a multiple length rod from which FIG. 11 filters can be obtained as previously described.

What is claimed is:

1. A tobacco smoke filter or filter element comprising a longitudinally extending core and a wrapper engaged around the core from end to end, wherein said wrapper having a radial inner face to which particulate additive adhere at one or more portion(s) thereof and having a circumference free of said additive at one or both ends of the core.

2. A filter or filter element according to claim 1 wherein the core has grooves extending longitudinally over a part of its length, particulate additive adhered to the radially inner face of the wrapper exending into the grooves.

3. A filter or filter element according to claim 1 wherein the wrapper has grooves extending longitudinally over a part of its length, particulate additive being adhered to the radially inner face of the wrapper at an ungrooved region thereof.

4. A filter element according to any one of claims 1–3 wherein the wrapper is itself surrounded by an outer tubular body.

5. A filter or filter element according to claim 4 further comprising an additional outer sleeve surrounding said tubular body.

6. A filter cigarette comprising a filter or filter element, said filter or filter element comprises a longitudinally extending core and a wrapper engaged around the core from end to end, said wrapper having a radial inner face to which particulate additive adhere at one or more portion(s) thereof and having a circumference free of said additive at one or both ends of the core.

7. A multiple length rod comprising a plurality of filter or filter elements joined integrally end to end in mirror image relation, wherein said filter or filter element comprises a longitudinally extending core and a wrapper engaged around the core from end to end, said wrapper having a radial inner face to which a particulate additive adhere at one or more portion(s) thereof and having a circumference free of said additive at one or both ends of the core.

8. A method of making a smoke filter or element which comprises continuously advancing a continuous core and a continuous strip having particulate additive adhered to a face thereof at longitudinally spaced regions, continuously wrapping the advancing strip around the advancing core (optionally simultaneously with core formation) with particulate additive against the core, and cutting the resulting continuously produced wrapped core into finite length.

* * * * *